United States Patent [19]

Cunningham

[11] Patent Number: 4,811,486

[45] Date of Patent: Mar. 14, 1989

[54] POCKET KNIFE

[75] Inventor: William D. Cunningham, Rocky Mount, N.C.

[73] Assignee: Atlanta Cutlery Corporation, Conyers, Ga.

[21] Appl. No.: 105,519

[22] Filed: Oct. 1, 1987

Related U.S. Application Data

[63] Continuation of Ser. No. 931,875, Nov. 17, 1986, abandoned, which is a continuation of Ser. No. 762,336, Aug. 3, 1985, abandoned.

[51] Int. Cl.[4] ..... B26B 3/06

[52] U.S. Cl. ..... 30/161; 30/151; 30/158

[58] Field of Search ..... 30/158, 151, 161

[56] References Cited

U.S. PATENT DOCUMENTS

| | | | |
|---|---|---|---|
| 4,442,600 | 4/1984 | Dalichou | 30/161 |
| 4,570,341 | 2/1986 | Konneker | 30/161 |

FOREIGN PATENT DOCUMENTS

| | | | |
|---|---|---|---|
| 1104386 | 4/1961 | Fed. Rep. of Germany | 30/158 |
| 19327 | 9/1896 | United Kingdom | 30/158 |

*Primary Examiner*—Frank T. Yost
*Assistant Examiner*—Willmon Fridie Jr.
*Attorney, Agent, or Firm*—Rodgers & Rodgers

[57] ABSTRACT

A knife with a retractable knife blade comprising a base element, a pivot pin formed in the base element, a knife blade mounted on the pivot pin and maneuverable between retracted and extended positions, an activation notch formed on one end of the blade, a sliding knob interconnected with the base element and the knife blade by means of a connecting arm for the purpose of moving the knife blade from the retracted to the extended position.

4 Claims, 2 Drawing Sheets

POCKET KNIFE

This is a continuation of application Ser. No. 931,875 filed Nov. 17, 1986, a continuation of application Ser. No. 762,336 filed Aug. 5, 1985, both abandoned.

TECHNICAL FIELD

This invention relates to knives which are easily carried on one's person when in a retracted position and which can be manipulated wherein the knife blade is conveniently and quickly positioned in an operating position.

BACKGROUND ART

Many different types of knives are known such as those having a stationary knife blade which must be stored in a knife sheath when not being used. Other types of knives are known such as a typical pocket knife in which the knife blade must be manuevered from a retracted position to an operating position. Of course this manual operation requires two hands. Also knives are known in which the blade, in its retracted position, is under a tension force such as by means of a spring or otherwise and which is released such as by pressing a button or the like. Various examples of these types of knives are disclosed in the following U.S. Pat. Nos. 587,692, 690,927, 1,478,260, 1,495,449, 1,864,011, 2,250,290, 4,233,106, 4,451,982.

DISCLOSURE OF THE INVENTION

By this invention, a knife is provided and comprises a base element, a pivot pin interconnected to the base element, a retractable knife blade mounted on the pivot pin, an activation notch formed on one end of the blade, and a sliding knob operably associated with the activation notch.

BEST MODE OF CARRYING OUT THE INVENTION

Figure 1:
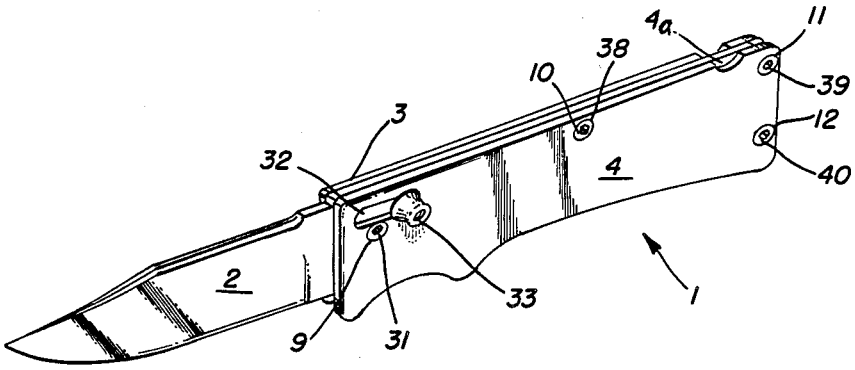
FIG. 1 is a perspective view of a knife constructed according to this invention with the knife blade in the extended position.

In the drawings and with particular reference to FIG. 1, the numeral 1 generally designates the base element of the knife constructed according to this invention. In FIG. 1, knife blade 2 is shown in its extended or operating position.

Figure 3:
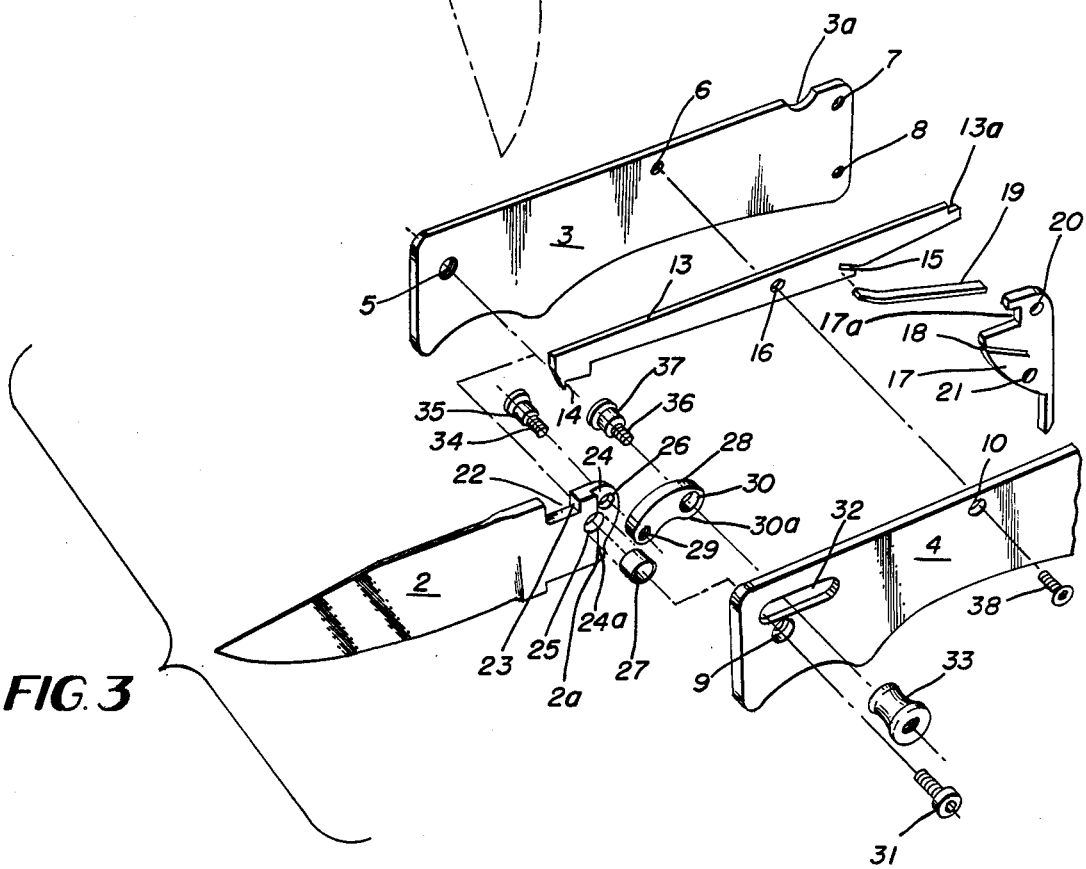
FIG. 3 is an exploded perspective view of the knife.

As best shown in FIG. 3, base element 1 comprises base plates 3 and 4. Formed in base plate 3 are threaded apertures 5, 6, 7 and 8 and notch 3*a*. In addition, apertures 9, 10, 11 and 12 are formed in base plate 4 and correspond respectively to threaded apertures 5, 6, 7 and 8. Apertures 11 and 12 are best shown in FIG. 1. Base plate 4 is also provided with notch 4*a*.

For the purpose of locking knife blade 2 in the extended position, locking pin 13 is provided. Locking pin 13 comprises locking surface 14 at one end thereof and locking notch 13*a* at the other end thereof. Locking slot 15 is generally formed in the lower portion of locking pin 13. In addition, aperture 16 is formed in locking pin 13. For the purpose of supporting one end of locking pin 13, base element 1 further comprises locking base 17 and which is provided with locking slot 18 and recess 17*a* both formed therein. In order to interconnect locking pin 13 and locking base 17, leaf spring 19 is provided and is adapted to cooperate with locking slots 15 and 18. Also apertures 10 and 21 are formed in locking base 17.

According to this invention, knife blade 2 is provided with locking notch 22 and locking notch 22 is provided with locking surface 23. In addition, activation notch 24 is formed on one end of knife blade 2. Also apertures 25 and 26 and safety notch 2*a* are formed in knife blade 2. Sleeve 27 is adapted to slide into aperture 25. In addition, connecting arm 28 is provided and formed therein are threaded aperture 29 and aperture 30.

For the purpose of providing pivot means for knife blade 2, pivot pin 31 is adapted to cooperate with sleeve 27 and to facilitate opening knife blade 2 to the operating position. Slot 32 is formed in base plate 4 and sliding knob 33 is adapted to slidably move along slot 32.

In order to form the knife according to this invention, initially it is necessary to insert sleeve 27 into apertures 25 of knife blade 2. Then the rear end of locking pin 13 is placed in abutting relation with recess 17*a* and leaf spring 19 is simultaneously inserted into slots 15 and 18. Connecting arm 28 is then attached to knife blade 2 by inserting threaded screw 34 through aperture 26 and into threaded aperture 29. Threaded screw 34 is provided with sleeve portion 35 which allows connecting arm 28 to pivot. Then threaded screw 36 is inserted through aperture 30 and slot 32 and into the interiorly threaded portion of sliding knob 33 and secured thereto. Threaded screw 36 is provided with sleeve portion 37 which allows connecting arm 28 to pivot and for threaded screw 36 to slide in slot 32.

Following this, base plates 3 and 4 are placed on opposite sides of locking pin 13 and locking base 17 whereby threaded apertures 5, 6, 7 and 8 in base plate 3 are aligned with corresponding apertures 9, 10, 11 and 12 disposed in base plate 4. In order to secure the various parts of the knife together, threaded screws 31, 38, 39 and 40 are inserted through corresponding apertures 9, 10, 11 and 12 and secured in threaded apertures 5, 6, 7 and 8 as is well known. The knife than appears as essentially shown in FIG. 4.

Figure 4:
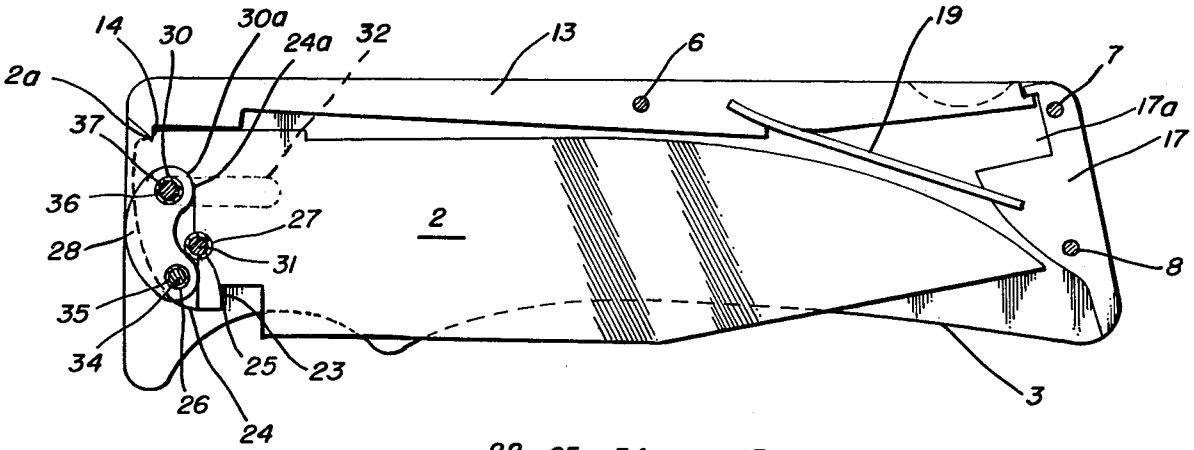
FIG. 4 is a side elevational view with one base plate removed and the knife blade in the retracted position.
Figure 5:
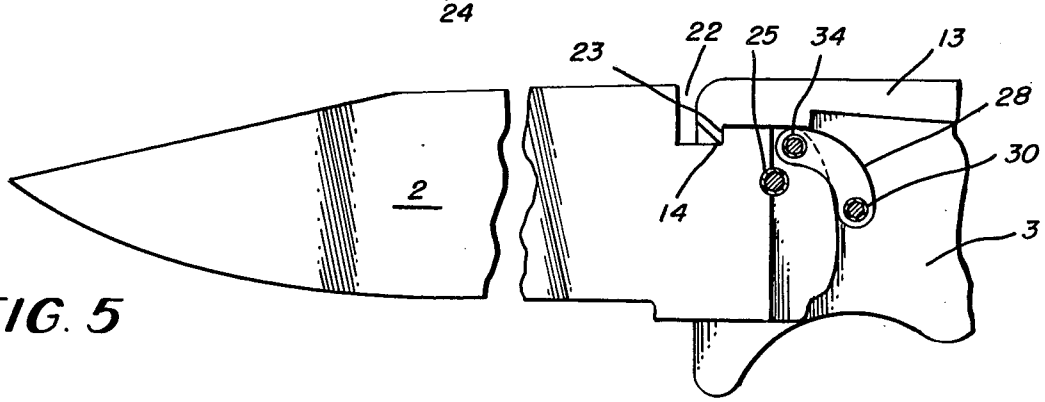
FIG. 5 is a side elevational view similar to FIG. 4 with the knife blade and associated structure in the extended position.

In order to manipulate the knife according to this invention and to maneuver knife blade 2 from a retracted position as shown in FIG. 4 to an extended position as shown in FIG. 1, it is simply necessary to exert a rearward force on sliding knob 33 which causes activation notch engaging surface 30*a* to come into contact with transverse surface 24*a* of activation notch 24 thereby causing knife blade 2 to begin to rotate in a clockwise direction. As sliding knob 33 continues to move rearwardly to impart a tension force to connecting arm 28 by the sliding action of sleeve 37 in slot 32, connecting arm 28 forces knife blade 2 to rotate by means of the fixed pivot interconnection between connecting arm 28 and knife blade 2 which is provided by threaded screw 34. When the sliding knob 33 reaches the rearward end of slot 32, knife blade 2 is in the fully extended position as shown in FIG. 1. Simultaneously knife blade 2 is locked in position when locking surface 14 snaps into abutting relationship with locking surface 23.

According to a feature of this invention, knife blade 2 is held securely in the closed position, as shown in FIG. 4, by means of the cooperation between locking surface 14 and safety notch 2*a*. By this means, knife blade 2 is actually locked in position and is thereby prevented from accidentally opening. When knife blade 2 is opened by means of the rearward manual pressure on sliding knob 33, the spring pressure of locking pin 13 on safety notch 2*a* is overcome and knife blade 2 is free to swing into the extended position. Also the back of knife blade 2 is undercut so that there is no interference between knife blade 2 and locking pin 13 during the opening operation.

Also according to this invention, locking pin 13 is prevented from overrotating since one end thereof is essentially secured in recess 17*a*. Without this feature, locking pin 13 would tend to rotate too far in the counterclockwise direction to a point where it would touch knife blade 2.

Figure 2:
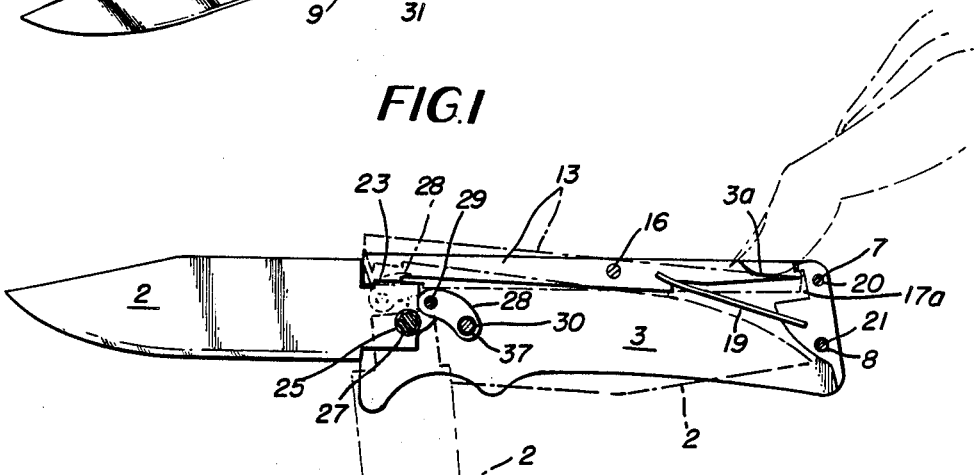
FIG. 2 is a side elevational view with the blade partially extended being shown in dotted lines.

In order to return knife blade 2 to its retracted position, initially locking pin 13 is depressed as shown in FIG. 2 which caues locking pin 13 to pivot about screw 38 thereby disengaging locking surface 14 from locking surface 23. Then knife blade 2 is manually swung in a counterclockwise direction to the position shown in FIG. 4 by a compression force imparted to connecting arm 28 whereby the end of locking pin 13 is disposed in recess 17*a*.

INDUSTRIAL APPLICABILITY

By this invention, a knife is provided by which the knife blade can be easily converted from a retracted to an extended position safely and conveniently without the need to utilize bulky knife sheaths or dangerous springs or other tension devices.

Claim:

1. A knife comprising a base element, a knife blade pivotally mounted on said base element about a fixed pivot and having an activation notch offset from one side of said blade to define a transverse surface intersecting said fixed pivot, a sliding knob reciprocally mounted on said base element for imparting opening and closing movement to said knife blade, a connecting arm having one end pivotally connected with said blade and having the other end pivotally connected with said sliding knob, said connecting arm being of arcuate configuration and defining near one end thereof an activation notch engaging surface initially in engagement with said transverse surface, and the pivotal connection between said connecting arm and said knife blade being spaced from said fixed pivot whereby initial blade opening movement of said sliding knob moves said activation notch engaging surface of said connecting arm with said transverse surface of said activation notch in the end of said knife blade thereby to initiate smooth opening movement of said knife blade and continuing opening movement of said sliding knob separates said notch engaging surface and said transverse surface and completes opening movement of said knife blade by imparting a continuous tension force to said connecting arm.

2. A knife according to claim 1 wherein said blade is closed by a compreessional force imparted to said connecting arm by said sliding knob.

3. A knife according to claim 1 wherein said base element comprises a pair of spaced base plates, a slot formed in one of said plates near one end thereof and closely spaced from said fixed pivot, and said sliding knob being slidably operable in association with said slot.

4. A knife according to claim 1 wherein a pivotally mounted locking pin is interconnected generally at one end thereof to said base element by means of a leaf spring and wherein a pair of locking notches are formed on opposite edges of said blade and are alternately engageable by the other end of said locking pin to hold said blade open or closed.

* * * * *